US005554235A

United States Patent [19]

Noe et al.

[11] Patent Number: 5,554,235

[45] Date of Patent: Sep. 10, 1996

[54] METHOD OF AND PROCESS FOR COLD-ROLLING OF STAINLESS-STEEL AND TITANIUM-ALLOY STRIP

[75] Inventors: Rolf Noe; Andreas Noe, both of Mülheim; Dieter Baukloh, Duisburg, all of Germany

[73] Assignee: BWG Bergwerk-Und Walzwerk-Machinenbau GmbH, Duisburg, Germany

[21] Appl. No.: 333,556

[22] Filed: Nov. 2, 1994

[30] Foreign Application Priority Data

Jul. 7, 1994 [DE] Germany ..... 44 23 664.6

[51] Int. Cl.[6] ..... C21D 8/02

[52] U.S. Cl. ..... 148/610; 72/392; 72/366.2; 29/81.08; 29/81.12; 266/103

[58] Field of Search ..... 148/670, 610; 29/33 R, 33 S; 72/39, 206, 365.2, 366.2; 134/2, 3; 266/103

[56] References Cited

U.S. PATENT DOCUMENTS 5,197,179 3/1993 Sendzimir .

FOREIGN PATENT DOCUMENTS

| | | | |
|---|---|---|---|
| 59-13028 | 1/1984 | Japan | 148/610 |
| 60-248889 | 12/1985 | Japan | 148/610 |
| 61-69926 | 4/1986 | Japan | 148/610 |
| 61-249602 | 11/1986 | Japan | 72/365.2 |
| 1234551 | 9/1989 | Japan | 148/670 |

*Primary Examiner*—Deborah Yee
*Attorney, Agent, or Firm*—Herbert Dubno

[57] ABSTRACT

A method and process line for producing cold-rolled stainless-steel or titanium-alloy strip from hot-rolled strip descales the hot-rolled strip by shot-blasting and/or brush-polishing and then cold-rolls the descaled strip. The cold-rolled strip, at its final thickness, is annealed and then pickled, all in a single continuous line.

15 Claims, 11 Drawing Sheets

METHOD OF AND PROCESS FOR COLD-ROLLING OF STAINLESS-STEEL AND TITANIUM-ALLOY STRIP

FIELD OF THE INVENTION

Our present invention relates to a method of producing cold-rolled steel strip of stainless-steel and metal strip, especially of titanium alloys. The invention also relates to a processing line for producing the cold-rolled steel or titanium-alloy strip.

BACKGROUND OF THE INVENTION

Hot-rolled steel strip, hot strip of stainless steel or titanium alloy and the like notoriously have relatively difficult to remove scale layers adherent to them and of varying hardness. As a result, the strip surface is generally nonhomogeneous.

To facilitate working of the steel strip by cold rolling, such steel strip is generally initially annealed. The annealed steel strip can then be subjected to a preliminary descaling operation to facilitate removal of the scale before the strip is pickled. The shot-blast descaling operation results in a roughening and homogenization of the strip surface.

The annealing, shot-blast descaling and pickling are carried out in a common processing line. As a consequence, the thus treated steel strip is wound up into a coil and supplied to a separate processing line containing the cold-rolling frames or mills. The cold-rolling operation results in a reduction of the strip thickness to the desired final thickness and amounts to a size calibration of the strip concurrently with a smoothing of the strip surfaces and a compacting of the strip.

The strength of the steel strip increases sharply with the cold-rolling operation so that its deformability is correspondingly reduced. As a result, cold-rolled steel strip must be subjected to a further annealing operation in which the strength of the steel strip is lowered by a recrystallization phenomenon and the deformability of the strip is increased. If the annealing is not carried out under a protective gas (blank annealing), annealing scale develops on the strip surface and must be again removed by a pickling operation. The annealing and pickling are again carried out in another treatment line, i.e. a so-called cold-strip line. The fabrication process just described is relatively time-consuming, energy-intensive and expensive because of the personnel costs.

In another known process, the hot strip is cold-rolled without pretreatment and after the cold-rolling is subjected to annealing and pickling.

In this case, the increased surface roughness must be acceptable since without it, the difficult to remove scale would remain to be rolled into the strip surface if the pretreated hot strip is to be subjected to cold-rolling in a continuous processing line (compare U.S. Pat. No. 5,197,179).

OBJECTS OF THE INVENTION

It is, therefore, the principal object of the present invention to provide a method of producing a cold-rolled stainless-steel or titanium-alloy strip which provides a saving as to time, energy and personnel by comparison with other methods, produces a strip with an exceptionally smooth surface and which, depending upon the composition of the strip, can have a bright or matte finish, and which otherwise is free from drawbacks of earlier fabrication techniques.

Another object of the invention is to provide an improved process line, i.e. apparatus, for carrying out this method.

It is another object of the invention to provide a highly economical method of producing cold-rolled stainless-steel or titanium-alloy strip which is more economical than earlier systems and nevertheless produces an improved product.

SUMMARY OF THE INVENTION

These objects and others which will become apparent hereinafter are attained, in accordance with the invention in a method of producing cold-rolled and titanium-alloy metal strip, especially titanium alloy, in which hot strip is shot-blasted and/or brush polished as part of an initial descaling operation, then cold-rolled and thereafter annealed and subsequently pickled.

Hot strip as this term is used in this application is intended to describe hot-rolled steel or metal strip which has been cooled to room temperature. The hot strip according to the invention can be brush-polished subsequent to the shot-blast descaler and optionally subjected again to shot-blast descaling.

It is also possible to brush-polish the hot strip prior to the shot-blast descaling. During the shot-blast descaling, a homogeneous descaled strip surface is obtained which, as a consequence of the brush polishing, is found to be especially deep cleaned, an operation that does not exclude the formation of longitudinally-extending grooves, furrows or channels in the surface.

According to the invention, the hot-rolled steel strip to which the scale is adherent is subjected prior to cold-rolling only to shot-blast descaling and/or brush-polishing, without either annealing or pickling. During the shot-blast peening and/or brush-polishing, the scale is mechanically removed practically completely. As a consequence, any inhomogeneities resulting from the presence of scale on the hot-rolled strip surfaces are eliminated prior to cold-rolling.

The substantially completely descaled steel strip, with its surface practically homogeneous, can then be subjected to cold rolling in one or more cold-rolling mills or frames in which the strip thickness can be reduced by up to 80% and in which the final thickness of the steel strip is established. The steel strip has a cold-rolled lattice structure as a result and the strength thereof is greatly increased. The strip surfaces are compacted and smooth.

After cold-rolling to the final strip thickness, the steel strip is annealed and the strength and shaping properties can be established in accordance with the usual industrial and marketing standards. While annealing does result in the formation of some annealing scale on the strip surfaces, the annealing scale can be removed by pickling the annealed strip utilizing conventional pickling operations.

After pickling the strip is practically free from scale and has the desired surface characteristics. It is a finished rolled steel or metal strip with the desired properties of the material selected from the strip and a high quality surface structure.

The cold-rolled strip of the invention is highly suitable when fabricated in stainless-steel or as metal strip from titanium alloys. The energy and personnel costs of the method of the invention are greatly reduced by comparison with earlier techniques. The scrap losses are greatly reduced and hence the productivity is high. The time for producing the finished steel strip is significantly reduced. These advantages are optimal when, in accordance with the invention, the steps described are carried out in a single processing line and continuously with the steps being sequential.

According to a feature of the invention, the hot strip prior to shot-blasting and/or brush-polishing, is subjected to stretch-bend leveling. The stretch-bend leveling serves not only to level the strip but also to break the scale and enable relatively uniform shot-blasting and/or brush-polishing.

The brush-polishing allows possible surface peaks to be removed. Such surface peaks are usually composed of ferritic steels which can break off in the cold-rolling mill to form particles which deposit on the rolls and reduce the lives thereof.

Generally the cold-rolled steel strip or metal strip is cooled after annealing, for example, by air cooling and/or water cooling.

Advantageously, the steel strip or metal strip between the cooling and pickling, can be subjected to stretch-bend leveling and/or shot-blast descaling and/or brush-polishing to enhance the chemical action during the pickling process. In the brush-polishing, the use of washing brushes is conceivable.

After pickling, the steel strip is scale-free and has an unusually smooth surface, and depending upon the properties of the material, can be bright or matte in finish.

By the use of dressing rollers or an after-rolling mill following pickling, the strip surfaces can be further compacted and smoothed. These dressing rolls or after-rolling rolls are intended to modify only the surface finish for the cold-rolled strip which is already at its final thickness. With a subsequent stretch-bend leveling or tension-leveling (tensioning), the planarity of the strip can be improved in the same processing line.

For the purposes of the invention, it is important that all of the operations which have been described thus far be carried out in a single continuous line.

According to the invention, therefore, a method of producing cold-rolled stainless-steel or titanium-alloy strip is carried in a single continuous line and comprises:

(a) descaling a hot-rolled stainless-steel or titanium-alloy strip in the single continuous line by at least one of the steps of:

(a1) shot blasting the hot-rolled stainless-steel or titanium-alloy strip, and (a2) brush polishing the hot-rolled stainless-steel or titanium-alloy strip, to produce a descaled hot-rolled stainless-steel or titanium-alloy strip;

(b) cold rolling the descaled hot-rolled stainless-steel or titanium-alloy strip in the single continuous line to produce a cold-rolled descaled stainless-steel or titanium-alloy product;

(c) annealing the cold-rolled descaled stainless-steel or titanium-alloy product in the single continuous line to produce an annealed strip; and (d) thereafter pickling the annealed strip in the single continuous line, thereby forming the cold-rolled stainless-steel or titanium-alloy strip.

The invention also provides a treatment line for carrying out the process of the invention with at least one shot-blast descaling device and/or polishing-brush unit, at least one cold-rolling mill following the descaler in the single processing line, an annealing furnace or oven following the last of the cold-rolling mills and a pickling unit following the annealing oven, the apparatus further including an uncoiling unit for supplying the hot-rolled strip to the descaler and a coiling unit taking up the cold-rolled strip following the last treatment along the line.

The shot-blast descaling and/or brush-polishing unit can be preceded by a stretch-bend leveler at the upstream side of the line.

Advantageously, between the annealing oven and the pickling bath, a cooling device is provided for air cooling and water cooling or quenching of the strip from the annealing oven. Between the cooling unit and the pickling bath, a further shot-blast descaling and/or brush-polishing can be provided. Downstream of the pickling unit, a dressing roll frame or an after-rolling frame can be provided for the purposes described.

Thus the processing line can comprise:

at least one descaler for descaling the hot-rolled stainless-steel or titanium-alloy strip to produce a descaled hot-rolled stainless-steel or titanium-alloy strip and including at least one descaling unit selected from a shot blaster and a brush polisher;

at last one cold-rolling mill connected in a single continuous line with the descaler for cold-rolling the descaled hot-rolled stainless-steel or titanium-alloy strip to produce a cold-rolled descaled stainless-steel or titanium-alloy product;

at least one annealing oven connected in the continuous line with the mill for annealing the cold-rolled descaled stainless-steel or titanium-alloy product to produce an annealed strip; and means forming at least one pickling bath connected to the oven in the continuous line to pickle the annealed strip.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
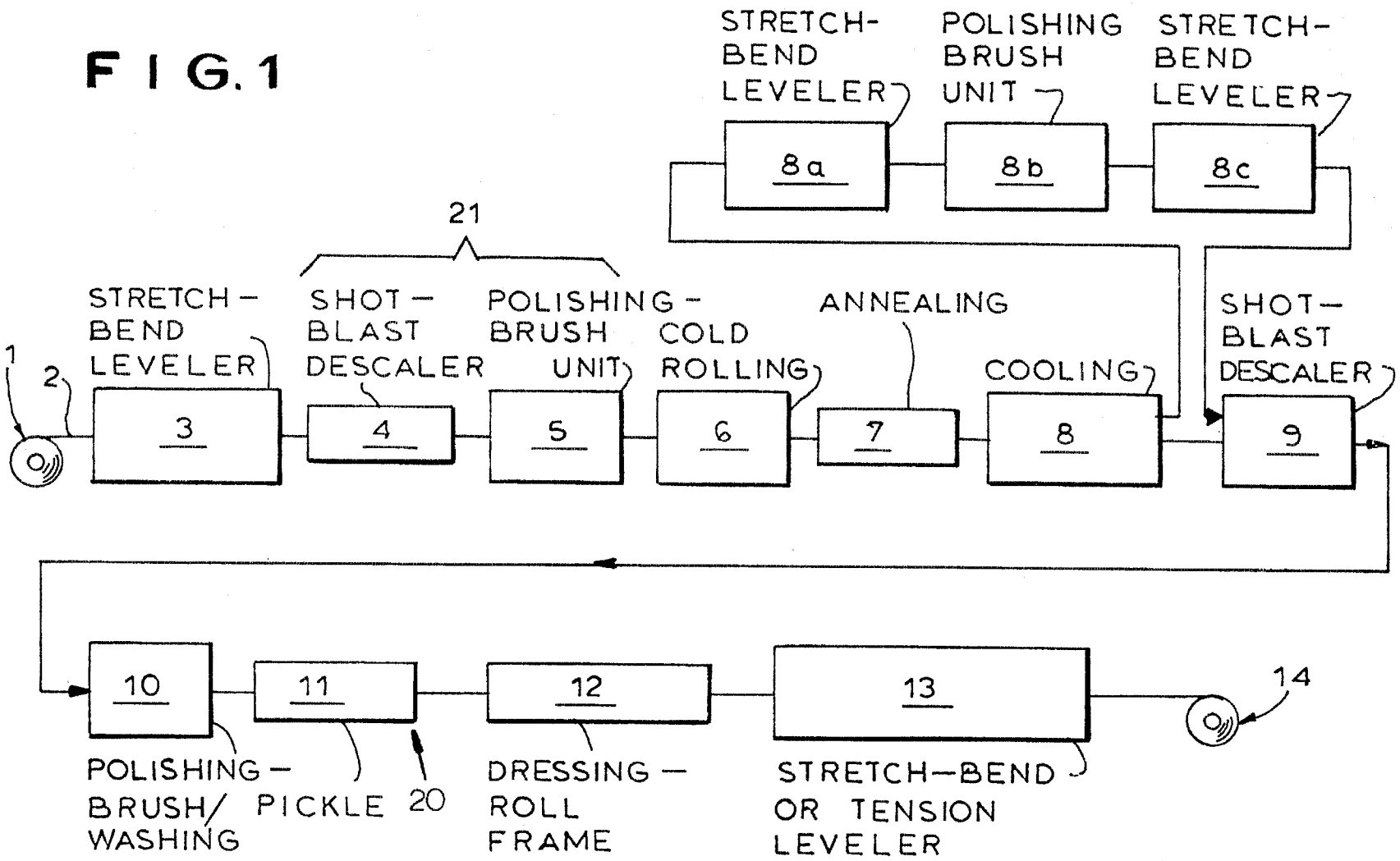
FIG. 1 is a block diagram of a processing line for carrying out the present method in highly diagrammatic form.
Figure 2:
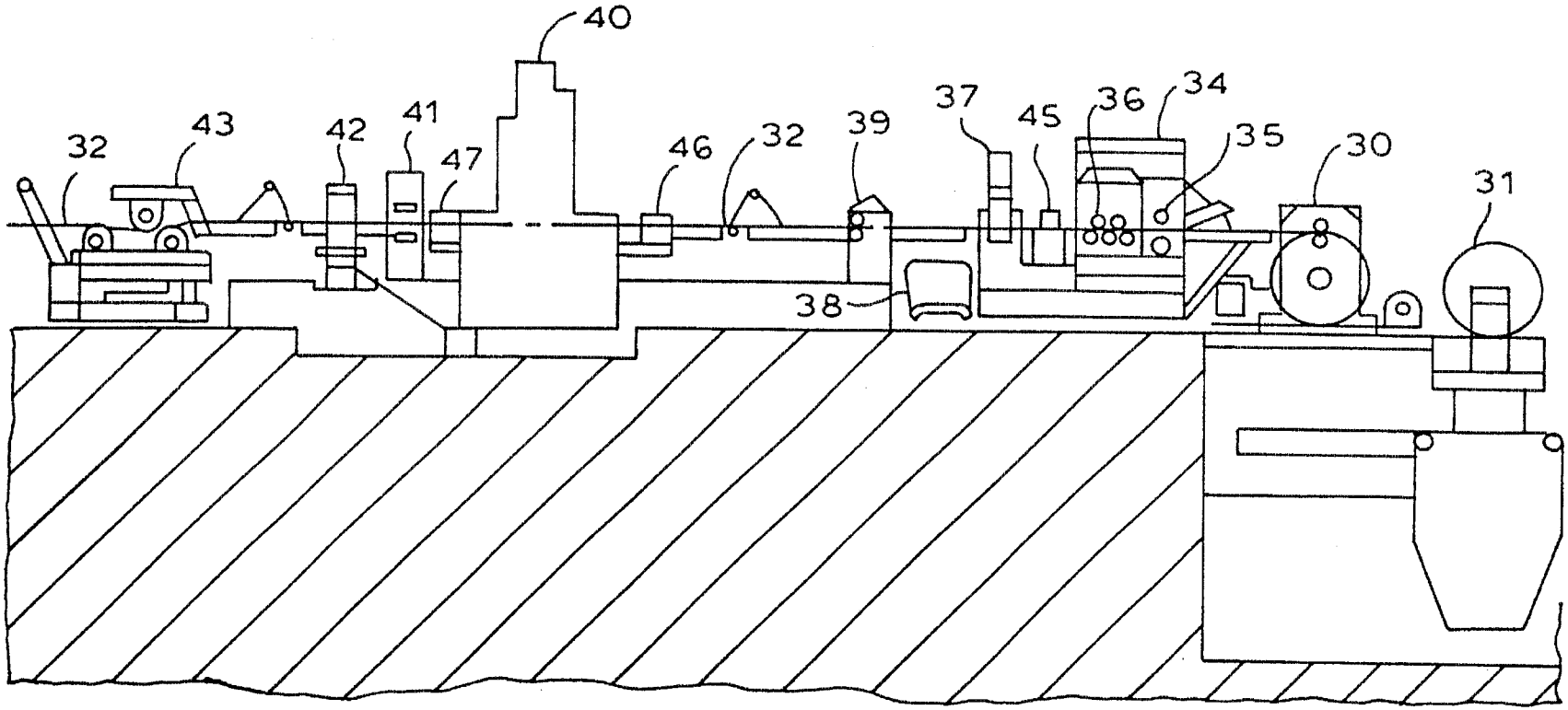
FIG. 2 is a side elevational view of the processing line at the upstream side thereof supplying the strip to the upstream leveler ahead of the shot-blast and brush-polisher descaler.
Figure 3:
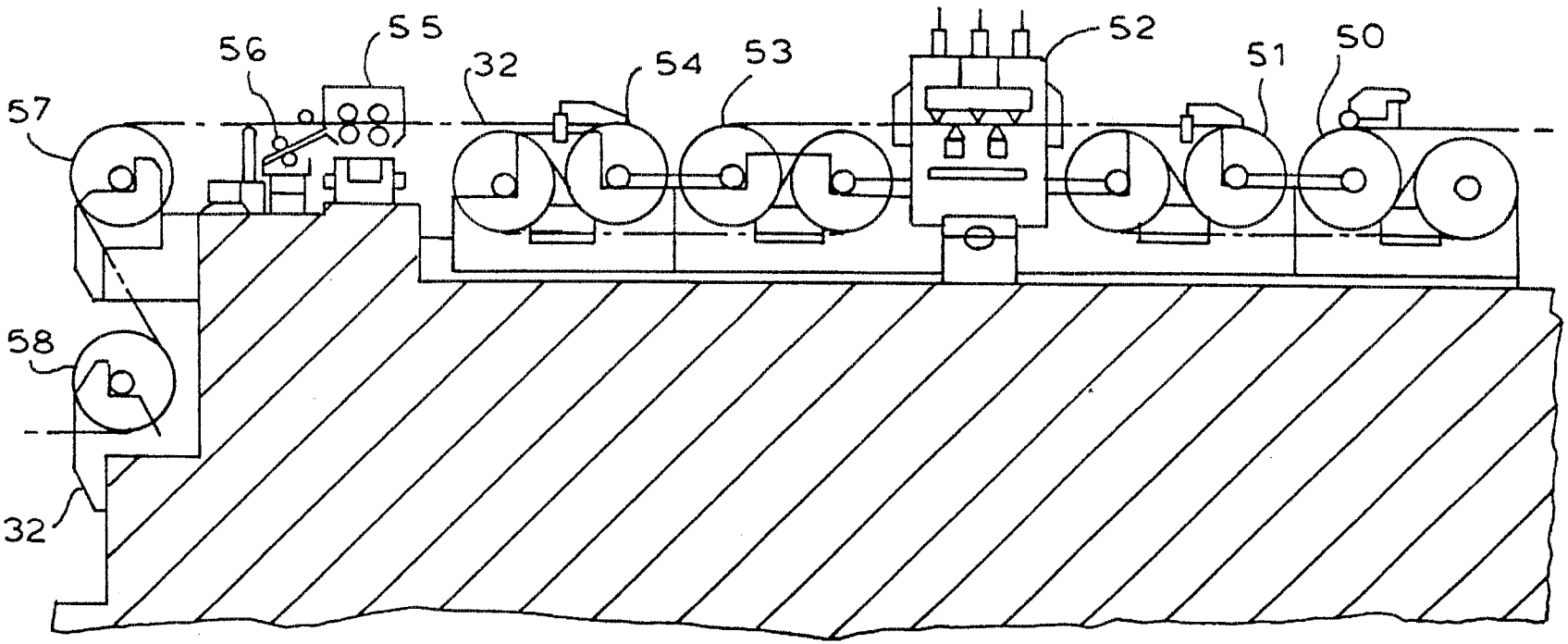
FIG. 3 is a view similar to FIG. 2 also showing the line upstream of the shot-blast descaling unit.

Turning to FIG. 1, it can be seen that a single continuous processing line, according to the invention can comprise an uncoiling unit 1 from which the hot-rolled strip is delivered to the continuous processing line represented generally at 20. An optional stretch-bend leveler 3 can be provided at an upstream end of this line and can be constructed as described at page 1186 of *The Making, Shaping and Treating of Steel*, United States Steel Co. 1985, Pittsburgh, Pa. The stretch-bend leveler 3 functions in part as a scale-breaker, the strip leaving the stretch-bend leveler is supplied to a descaling section represented at 21 and which can include a shot-blast descaler 4 which can be followed by a polishing-brush unit 5.

The shot-blast descaler may have the construction described at pages 1083–1096 of *The Making, Shaping and Treating of Steel*, op. cit.

The use of brush-polishing is described at page 1128 of *The Making, Shaping and Treating of Steel.*

Immediately following the polishing-brush unit 5, cold-rolling is effected on one or more cold-rolling mills 6 (see pages 1103 ff. of *The Making, Shaping and Treating of Steel*), and the cold-rolling stage 6 is followed by an annealing stage 7 utilizing an annealing oven which can employ the systems described at pages 1110 ff of *The Making, Shaping and Treating of Steel.* The annealing stage 7 is followed by a additional cooling which can employ air coolers and water quenchers and may, if desired, be followed by a stretch-bend leveler 8*a*, a polishing-brush unit 8*b* and if desired, another stretch-bend leveler 8*c* upstream of a shot-blast descaler 9 which can be of the construction previously described.

The single processing line continues with another polishing-brush unit 10 or a washing-brush unit. The strip then enters the pickling unit 11 which can be of the type described at pages 1087 ff of *The Making, Shaping and Treating of Steel.*

Following the pickling baths, the strip, while continuously displaced along the line, can pass through a dressing-roll frame 12 in which the mill rolls improve the surface character of the strip without further reducing its thickness. The strip may be then passed through a stretch-bend leveler or a tension leveler 13, the principles of a tension leveler being represented at page 1119 of *The Making, Shaping and Treating of Steel.* The strip, at the end of this line, is collected in a coil on a coil-winder 14.

The apparatus which may be used is shown in greater detail in FIGS. 2–11.

In particular, the unwinding unit 30, receiving a coil from the coil car can pay out the hot-rolled strip 32 through an entry deflector 34 having a pinch-roll unit 35 which is provided upstream of a stretch-bend leveler 36 from which the strip passes a shear 37 at which defective strip can be removed as scrap into the scrap car 38.

Passing between another pair of pinch rollers 39, the strip can feed through a welder 40 which welds successive pieces of the strip together into a continuous band and welds the trailing end of a strip from a preceding coil onto the leading edge of the strip of a succeeding coil.

From the welder via pinch rollers 41, the strip passes through a conventional notcher 42 to a steering roll unit 43. The strip 32, which is centered between centering units 45, 46 and 47, is then fed via bridles 50 and 51 (FIG. 3) through a stretch-bend leveler 52 which serves as a scale-breaker in the manner described. Downstream of the stretch-bend leveler 52 are two other bridles 53 and 54 from which the strip 32 passes through a side trimmer 55 associated with a scrap chopper 56 for cutting up the side trim scrap.

Figure 4:
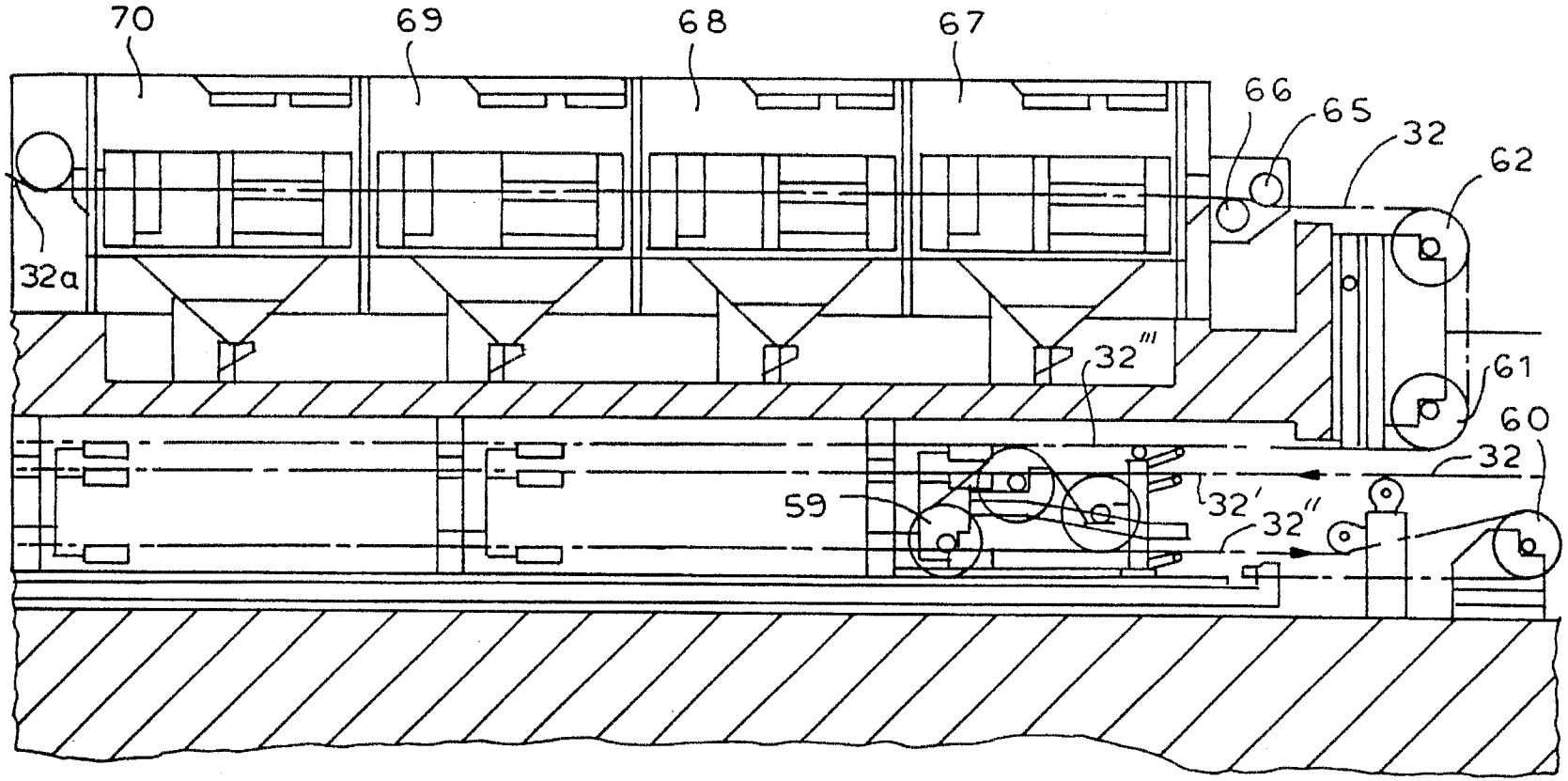
FIG. 4 is a view similar to FIGS. 2 and 3 showing the shot-blast descaling unit.
Figure 5:
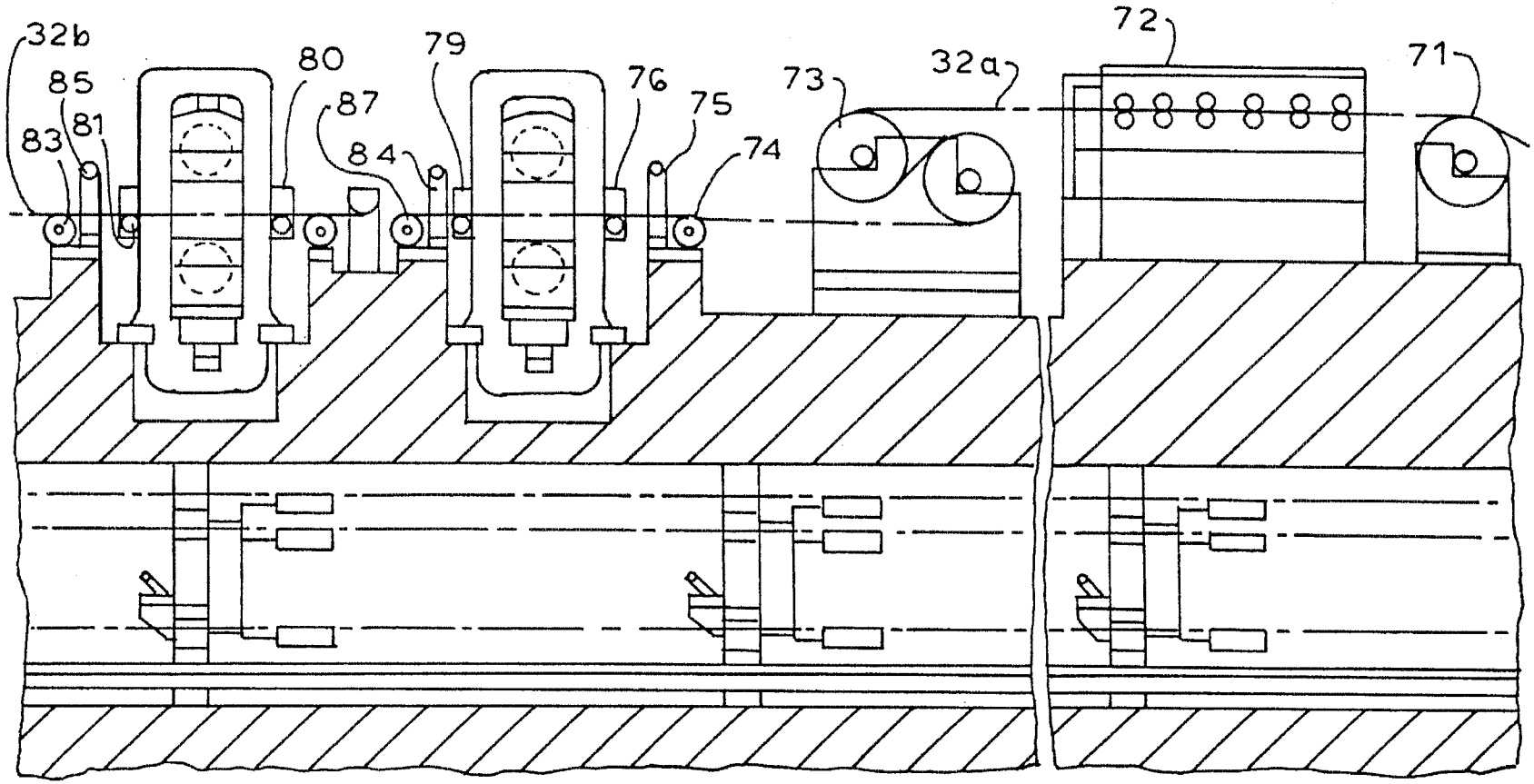
FIG. 5 is another side elevational view of the processing line illustrating the cold-rolling mills and the brush-polisher upstream thereof.

Via rolls 57 and 58, the strip 32 is fed to a lower level of the line at which a looper car 59 is provided, the strip returning from the looper car in a pass 32' over a steering roll 60 to form a lower pass 32" which, at the looper car passes at 32'" to the double-steering roll 61 and 62 to return at 32 to the upper level (FIG. 4).

Figure 6:
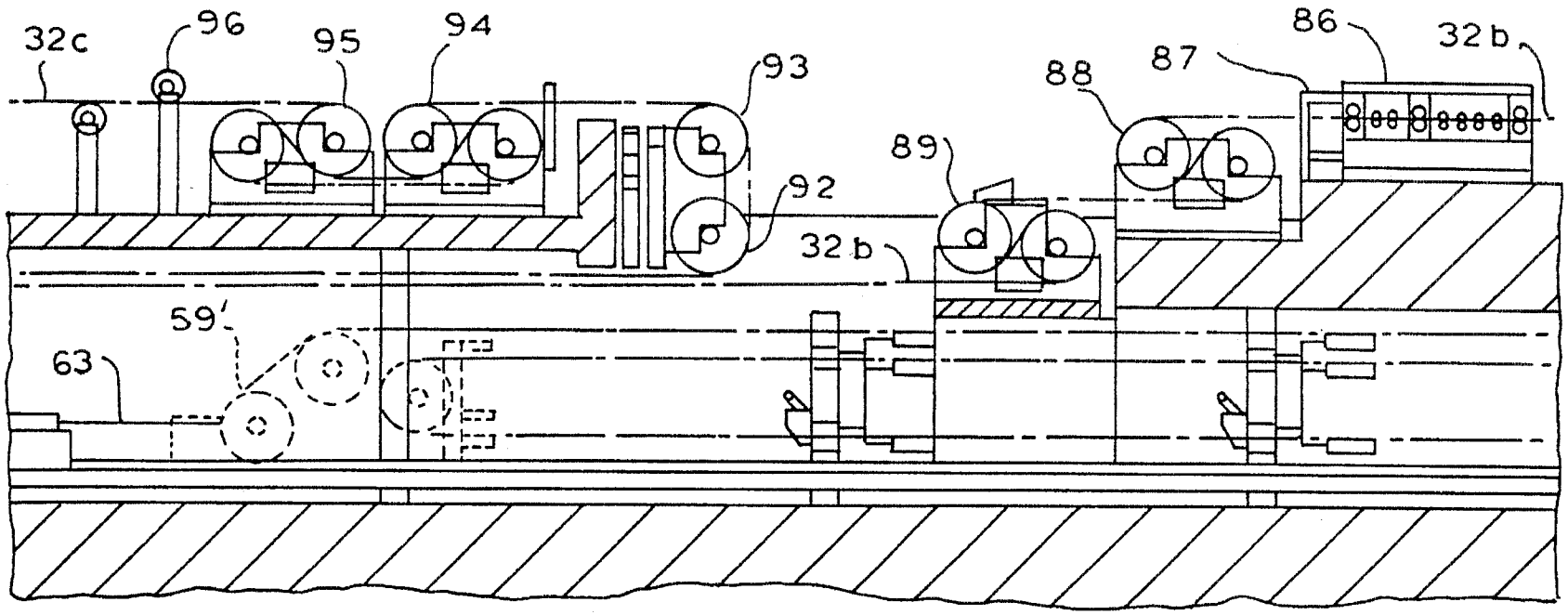
FIG. 6 is a similar view of a portion of the line upstream of the annealing oven and including the washer and drier according to the invention.
Figure 7:
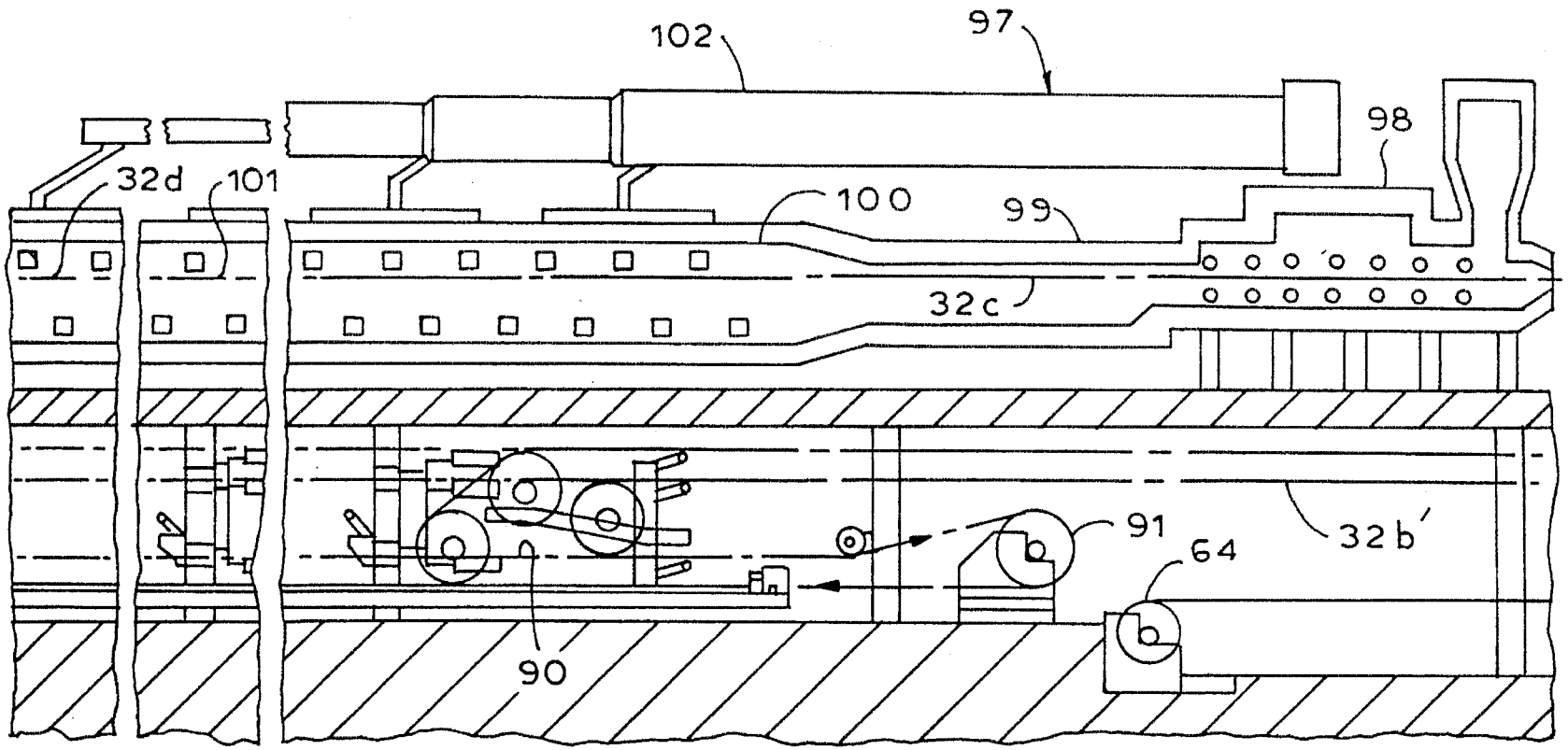
FIG. 7 is a sectional view in highly diagrammatic form showing the annealing oven segment of the processing line.

In FIG. 6, the looper car 59 is shown in phantom lines 59' at its extreme left-hand position and is drawn into this position by a cable 63 of an entry looper car drive 64 (FIG. 7).

Returning to FIG. 5, it can be seen that the strip 32 passes between rollers 65 and 66 into the first of four shot-blast chambers 67, 68, 69 and 70 and then travels through the remaining chambers where both sides of the strip are subjected to shot peening. The shot-peened strip at 32*a* is then passed over a steering roller 71 through a brush polisher 72 and then via a steering bridle 73 to a tension-measuring unit 74 and an X-ray gauge 75, both known in the art. The strip passes through a two-roll wiper 76 into the first of two cold-rolling mills 77 and 78, each of which is preceded and followed by such wipers as are represented at 79, 80 and 81.

Other tension-measuring devices are provided at 82 and 83 while additional X-ray gauges are provided at 84 and 85.

The cold-rolled strip 32*b* (FIG. 6) is fed through a washer 86 and a dryer 87 to bridles 88 and 89, the latter directing the strip 32*b* to the lower level where it passes to a process looper car 90, then over a steering roll 91 and returns at 32*b'* (FIG. 7) to the double-steering rolls 92, 93 (FIG. 6) upstream of bridles 94 and 95. After passing another tension-measuring unit 96, the strip 32*c* enters the annealing oven represented generally at 97 and comprising a convection zone 98, a radiation zone 99 and three heating zones of which only the first zone 100 and the last heating zone 101 can be seen. The gases which emerge from the oven are carried away by the ducts 102.

The annealed strip emerging at 32*d* (FIGS. 7 and 8) enters the cooling segment 103 of the line which can include four air-cooling units 104, 105, 106 and 107, travels in succession by this strip, a water-cooling or quenching unit 108 and a dryer 109.

Figure 8:
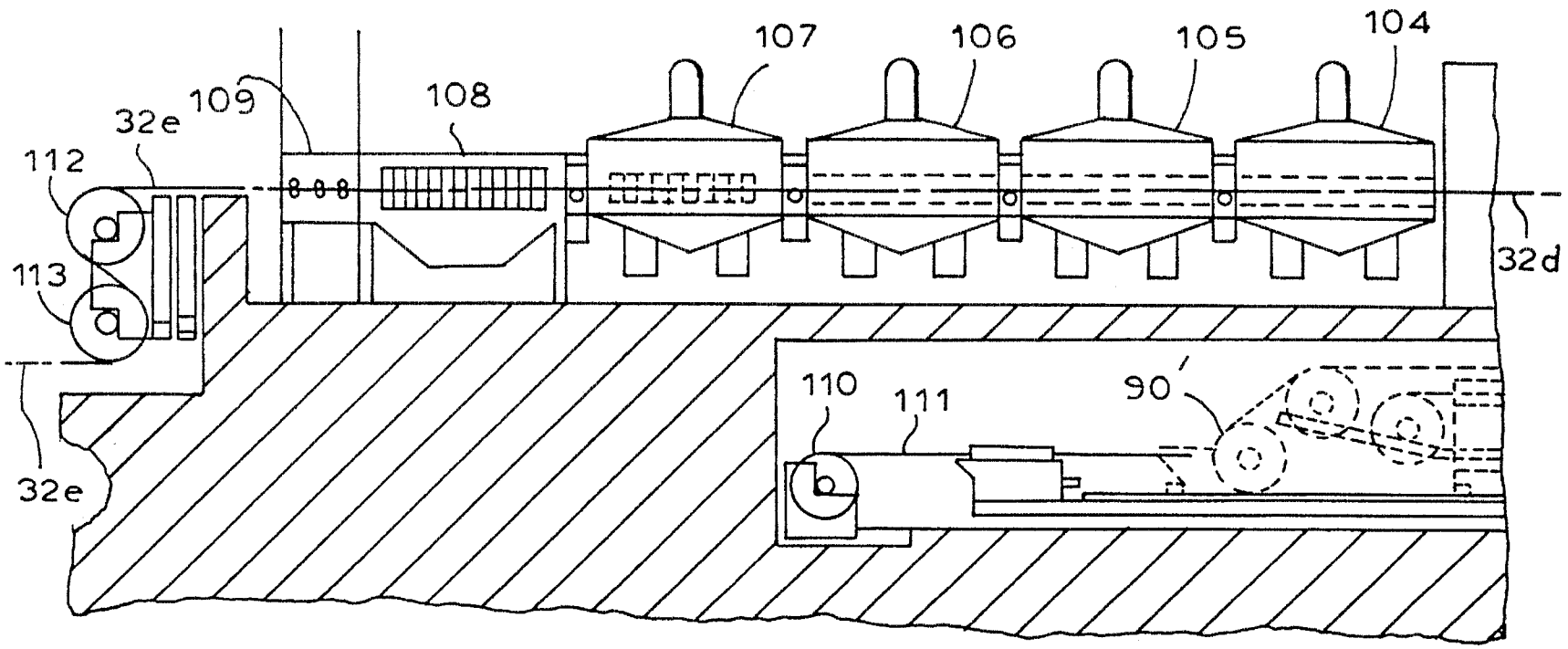
FIG. 8 is a similar view of the air-cooling and water-quenching segment of the line.

Also visible in FIG. 8 is the process looper car drive 110 which is connected by the cable 111 to the process looper car 90 shown in phantom lines at 90' in FIG. 8 in its most extreme left-hand position.

The dried and cooled annealed strip 32*e* passes over the double-steering rolls 112 and 113 to a bridle 114 which is followed immediately by a shot-blast chamber 115 in which the strip is again subjected to shot-blast descaling before passing at 32*f* over a tension-measuring roll 116 to a brush polisher 117. From the brush polisher, the strip 32*g* passes into the pickling unit 118 which can include a plurality of pickling tanks 119, 120 and 121 only the first, second and last of which have been illustrated.

Figure 9:
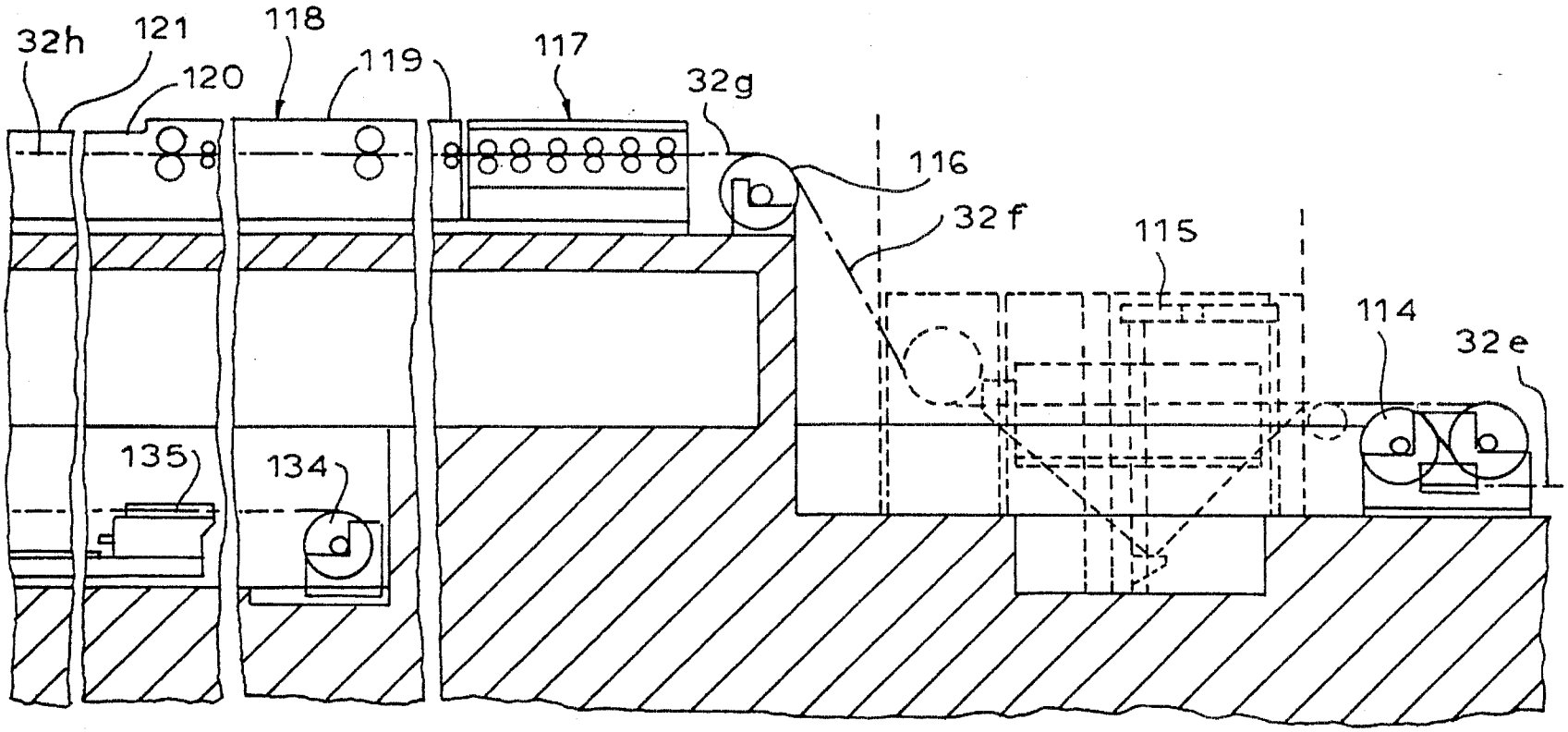
FIG. 9 represents the pickling section of the line, partly broken away and thus showing only some of the pickling baths.
Figure 10:
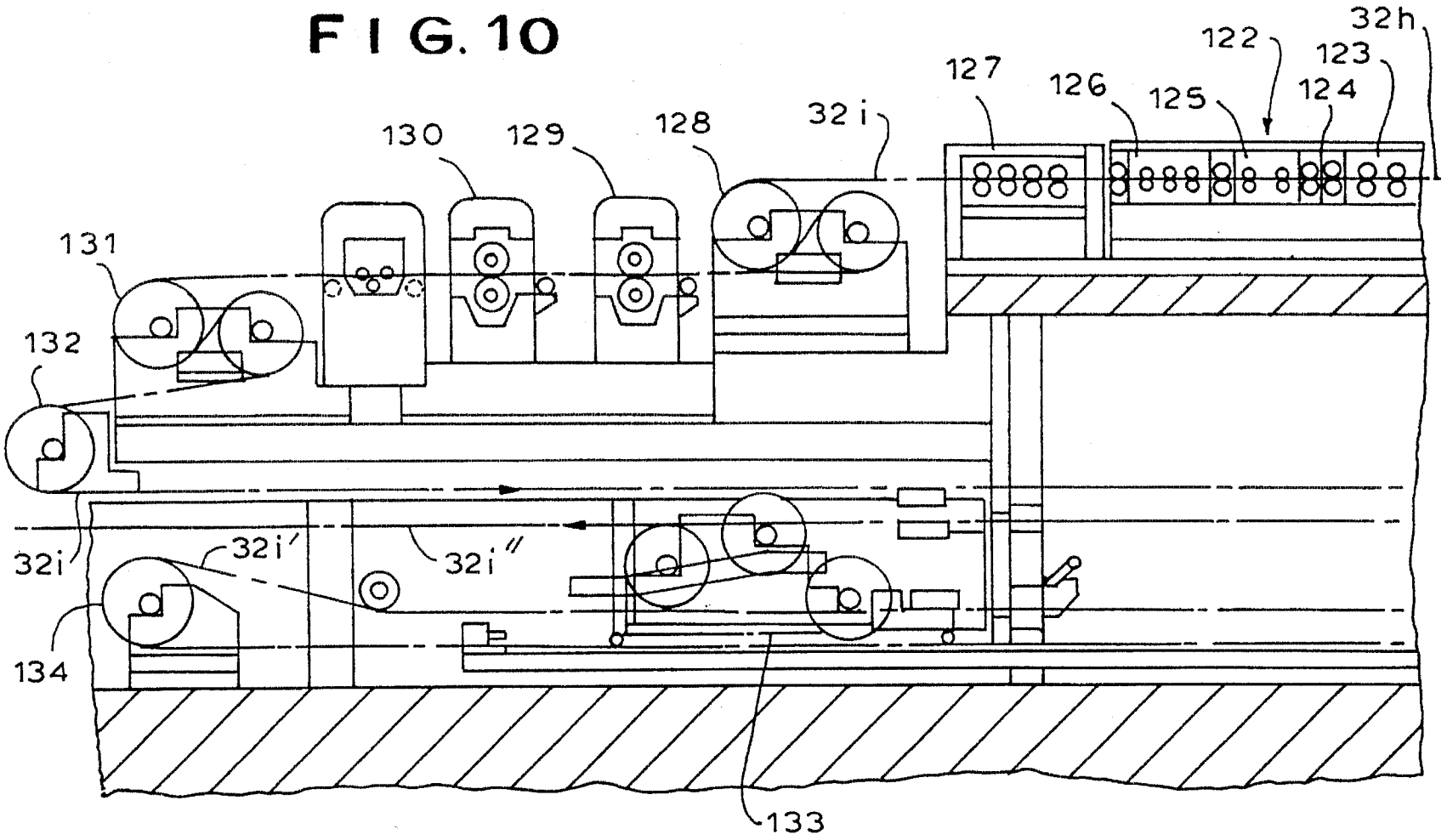
FIG. 10 is a view of the rinsing and drying section of the processing line downstream of the pickler and provided with further leveling units.

Between these pickling tanks additional brush polishers and intermediate rinsing stages can be provided and it is preferred to have at least four pickling tanks with brush polishers between the second and third pickling tanks and an intermediate rinse between the third and fourth pickling tank. The pickled strip 32*h* (FIGS. 9 and 10) passes through a rinsing unit 122 which can include a spray-rinse tank 123, a brush polisher 124, a spray-rinse tank 125 and a spray-rinse tank 126 followed by a dryer 127. The completely descaled strip is fed at 32*i* through the steering bridle 128 to levelers 129 and 130 and then via a bridle 131 to a roller 132 guiding the strip 32i onto an exit-looper car 133 which can be drawn to the right by the exit-looper car drive 134 connected via the cable 135 with the exit-looper car (FIG. 9).

The units 129 and 130 can function as dressing rolls for treating the surfaces of the strip without modifying the thickness.

The strip 32i passes from the exit-loop car 133 at 32*i* over the steering roll 134 back to the car 133 and then from the car with the pass 32*i*" to the bridle 135.

Figure 11:
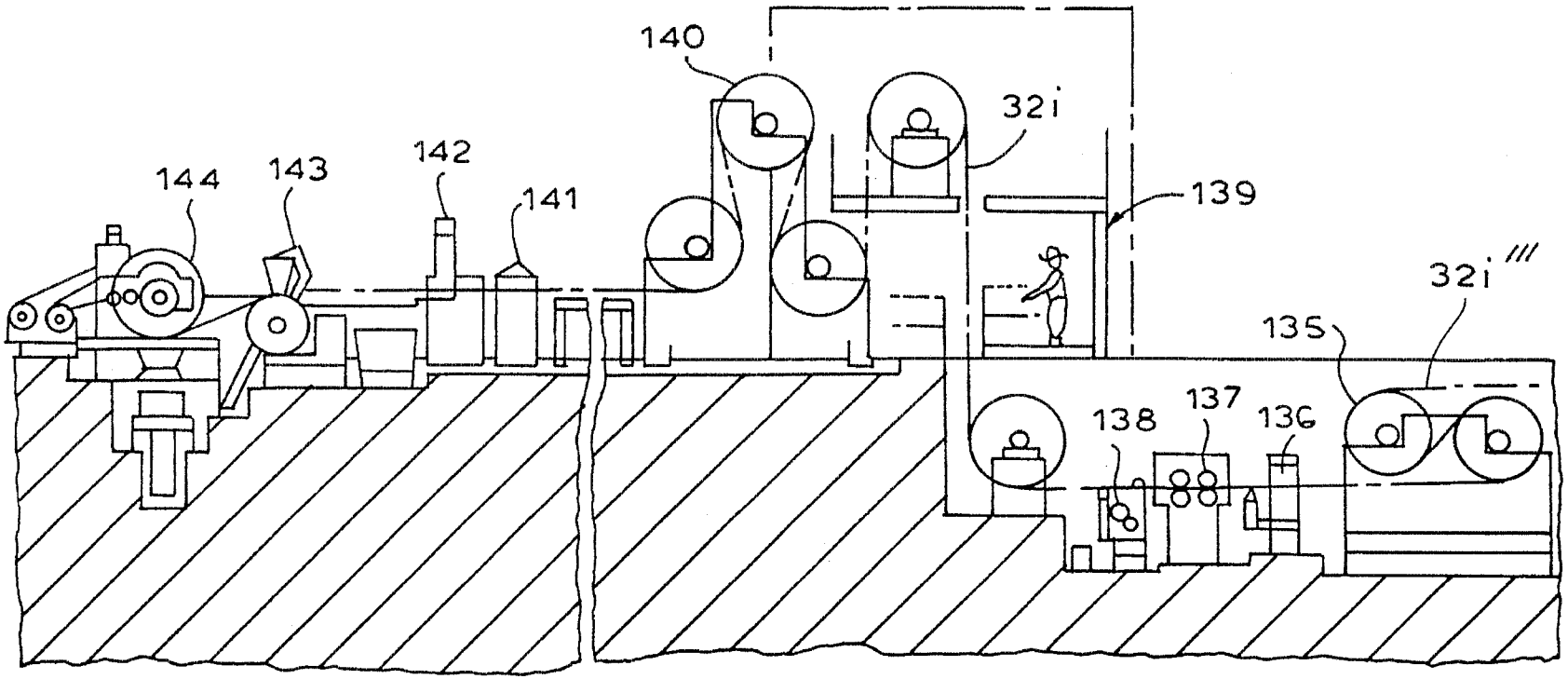
FIG. 11 is a similar view of the discharge portion of the line in which the strip is rewound into a coil.

The strip then passes through a notcher 136, a side trimmer 137 with its scrap chopper 138 and an inspection station 139 where the strip 32*j* is inspected. The strip passes over another bridle 140 between pinch rolls 141 to an exit shear 142 severing the continuous strip between the wound-up coils and then through an exit deflector and pinch-roll unit 143 to the coil winder 144. (FIG. 11).

The apparatus shown in greater detail in FIGS. 2–11 operates in principle in the same manner as that described in connection with the block diagram of FIG. 1.

We claim:

1. A method of producing cold-rolled stainless-steel or titanium-alloy strip from hot-rolled stainless-steel or titanium-alloy strip, said method comprising the steps of, in a single continuous line and in succession in said line:

(a) descaling a hot-rolled stainless-steel or titanium-alloy strip while displacing said strip along said single continuous line by at least one of the steps of:

(a1) shot blasting the hot-rolled stainless-steel or titanium-alloy strip, and (a2) brush polishing the hot-rolled stainless- steel or titanium-alloy strip, to produce a descaled hot-rolled stainless-steel or titanium-alloy strip;

(b) thereafter cold rolling the descaled hot-rolled stainless-steel or titanium-alloy strip to a final strip thickness while displacing said strip along said single continuous line to produce a cold-rolled descaled stainless-steel or titanium-alloy product;

(c) subsequently annealing said cold-rolled descaled stainless-steel or titanium-alloy product while displacing said strip along said single continuous line to produce an annealed strip; and (d) thereafter pickling the annealed strip while displacing same along said single continuous line, thereby forming the cold-rolled stainless-steel or titanium-alloy strip.

2. The method defined in claim 1 wherein in step (a) the hot-rolled stainless-steel or titanium-alloy strip is shot blasted and then brush polished for descaling in said single continuous line to produce said descaled hot-rolled stainless-steel or titanium-alloy strip.

3. The method defined in claim 2 wherein the hot-rolled stainless-steel or titanium-alloy strip is shot blasted after the brush polishing for descaling in step (a).

4. The method defined in claim 1 wherein for descaling in step (a), the hot-rolled stainless-steel or titanium-alloy strip is brush polished and then shot blasted.

5. The method defined in claim 1 wherein prior to descaling in step (a), the hot-rolled stainless-steel or titanium-alloy strip is subjected to stretch-bend leveling.

6. The method defined in claim 1 wherein, following annealing in step (c) the annealed strip is cooled by at least one of the steps of:

air cooling, and water quenching.

7. The method defined in claim 6 wherein following the cooling of the annealed strip and prior to pickling in step (d), the annealed strip is subjected to at least one of the steps of:

stretch-bend leveling, shot blasting, and brush polishing.

8. The method defined in claim 1 wherein the strip subsequent to pickling is subjected to after rolling or dressing.

9. The method defined in claim 8 wherein said after-rolling or dressing is carried out in said single continuous line.

10. A processing line for producing cold-rolled stainless-steel or titanium-alloy strip from hot-rolled stainless-steel or titanium-alloy strip, said processing line comprising:

at least one descaler for descaling the hot-rolled stainless-steel or titanium-alloy strip to produce a descaled hot-rolled stainless-steel or titanium-alloy strip and including at least one descaling unit selected from a shot blaster and a brush polisher;

at last one cold-rolling mill connected in a single continuous line with said descaler for cold-rolling the descaled hot-rolled stainless-steel or titanium-alloy strip to produce a cold-rolled descaled stainless-steel or titanium-alloy product;

at least one annealing oven connected in said continuous line with said mill for annealing the cold-rolled descaled stainless-steel or titanium-alloy product to produce an annealed strip; and means forming at least one pickling bath connected to said oven in said continuous line to pickle the annealed strip.

11. The processing line defined in claim 10 wherein a cooler is provided between said pickling bath and said oven for cooling the annealed strip before the annealed strip enters said pickling bath in said continuous line.

12. The processing line defined in claim 11, further comprising a stretch-bend leveler along said continuous line upstream of said descaler for leveling the hot-rolled stainless-steel or titanium-alloy strip prior to descaling thereof.

13. The processing line defined in claim 12 wherein said cooler includes at least one unit chosen from an air cooler and a water cooler.

14. The processing line defined in claim 13, further comprising along said continuous line between said cooler and said pickling bath at least one descaler chosen from a shot blaster and a polishing-brush unit.

15. The processing line defined in claim 11, further comprising downstream of the pickling bath along said continuous line at least one subsequent rolling frame chosen from an after rolling frame and a dressing rolling frame.

* * * * *